US008047638B2

(12) United States Patent
Date et al.

(10) Patent No.: US 8,047,638 B2
(45) Date of Patent: Nov. 1, 2011

(54) LIQUID EJECTING APPARATUS

(75) Inventors: Masakazu Date, Tokyo (JP); Nobuhiro Ueno, Osaka (JP)

(73) Assignee: Konica Minolta Holdings, Inc. (JP)

( * ) Notice: Subject to any disclaimer, the term of this patent is extended or adjusted under 35 U.S.C. 154(b) by 993 days.

(21) Appl. No.: 11/913,711

(22) PCT Filed: May 9, 2006

(86) PCT No.: PCT/JP2006/309275

§ 371 (c)(1),
(2), (4) Date: Nov. 6, 2007

(87) PCT Pub. No.: WO2006/121022

PCT Pub. Date: Nov. 16, 2006

(65) Prior Publication Data

US 2009/0079794 A1 Mar. 26, 2009

(30) Foreign Application Priority Data

May 11, 2005 (JP) ..... 2005-138786

(51) Int. Cl.
*B41J 2/06* (2006.01)
*B41J 2/085* (2006.01)

(52) U.S. Cl. ..... 347/76; 347/55

(58) Field of Classification Search ..... 347/54, 347/55, 74, 76, 79

See application file for complete search history.

(56) References Cited

U.S. PATENT DOCUMENTS 6,341,851 B1 * 1/2002 Takayama et al. ..... 347/70

FOREIGN PATENT DOCUMENTS

| | | |
|---|---|---|
| JP | 5-104725 | 4/1993 |
| JP | 5-278212 | 10/1993 |
| JP | 6-134992 | 5/1994 |
| JP | 2003-53977 | 2/2003 |
| WO | 03-070381 | 8/2003 |

* cited by examiner

*Primary Examiner* — Kevin S Wood

(74) *Attorney, Agent, or Firm* — Cantor Colburn LLP

(57) ABSTRACT

In a liquid ejecting apparatus using the electrostatic attraction method or electric field assist method, a liquid ejecting apparatus where discharging of a nozzle plate is securely performed and appropriate liquid ejecting is possible is provide. The liquid ejecting apparatus is provided with an electrode; a liquid ejecting head, having, a nozzle plate including a nozzle opposed to the counter electrode to eject liquid, a pressure generating device to rise a meniscus of liquid at a ejecting port of the nozzle, and a charging electrode opposed to the counter electrode via the nozzle plate, an electrostatic voltage applying device to apply electrostatic voltage onto the liquid in the nozzle; a discharging device to discharge the charged nozzle plate; and a control device to control the electrostatic voltage applying device and the discharging device; wherein the discharging device provides a conductive discharging member detachable to an whole area of the nozzle plate opposed to the counter electrode.

22 Claims, 12 Drawing Sheets

FIG. 11 ( A )
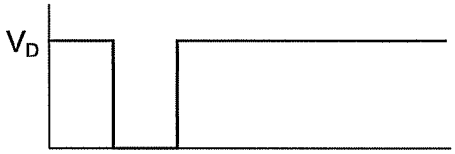
FIG. 11 ( B )
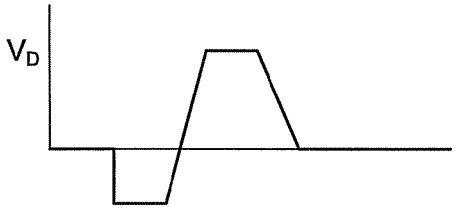
FIG. 11 ( C )
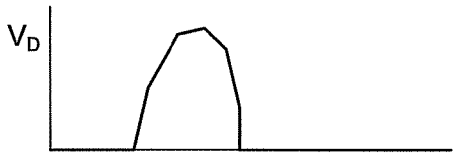

FIG. 14 ( A )
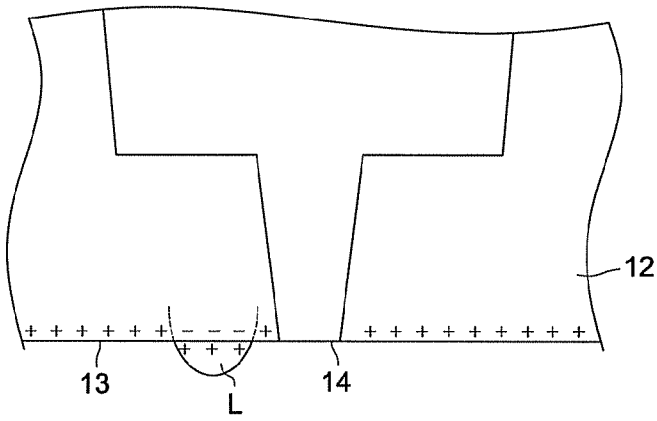
FIG. 14 ( B )
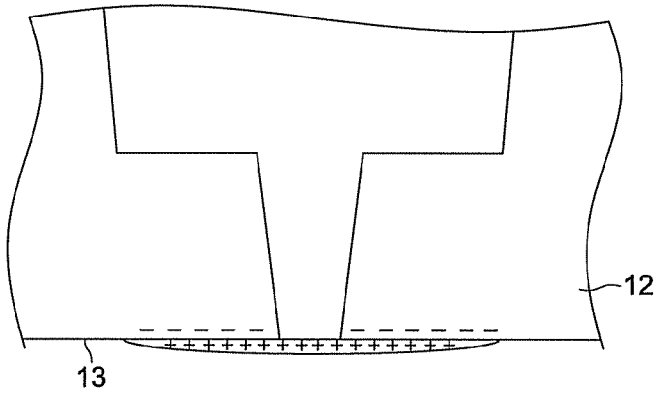
FIG. 14 ( C )
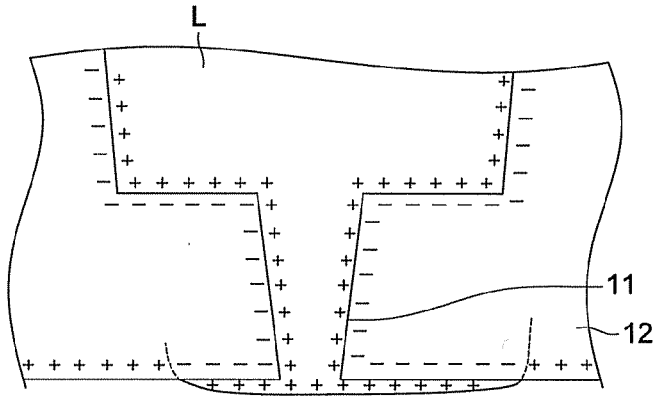

LIQUID EJECTING APPARATUS

CROSS REFERENCE TO RELATED APPLICATIONS

This is a U.S. national stage of application No. PCT/JP2006/309275, filed on 9 May 2006. Priority under 35 U.S.C. §119(a) and 35 U.S.C. §365(b) is claimed from Japanese Application No. 2005-138786, filed 11 May 2005, the disclosure of which is also incorporated herein by reference.

FIELD OF THE INVENTION

The present invention relates to a liquid ejecting apparatus and in particular to a liquid ejecting apparatus having a discharging device to discharge a nozzle plate of a liquid ejecting head.

BACKGROUND OF THE INVENTION

In recent years, in accordance with development of high resolution image forming and expansion of application for industrial use of inkjet printers, demands for forming a high solution patter and ejecting of high viscosity ink have been increasing. To cope with these issues with conventional inkjet recording method, nozzles have to be miniaturized and an ejecting force has to be increased so as to eject the high viscosity ink. Thus a drive voltage has to be increased which increases a cost of the head and the apparatus. Therefore the apparatus capable of practical used has not been realized.

Thus, to meet with the demands, so-called a statistic electric attraction method liquid ejecting technology, wherein liquid in the nozzle is charged and the liquid droplet is ejected by an electrostatic attraction force created by an electric field formed between various substrates configuring an object to receive the droplet and the nozzle, is known as a technology to eject high viscosity liquid as well as low viscosity liquid from miniaturized nozzle (Patent document 1).

Also, a liquid ejecting apparatus utilizing so-called electric field assist method where the above liquid ejecting technology and a technology using a pressure by distortion of a piezoelectric element or by creation of air bubbles in the liquid are combined has been developed (for example refer to Patent documents 2 to 5). In this method, a meniscus of liquid is protrudeed at an ejecting port of the nozzle using a meniscus forming device and the electrostatic attraction force so as to increase the electrostatic attraction force for the meniscus and eject the meniscus as a liquid droplet beyond a liquid surface tension.

Patent Document: International Publication 03/070381 Pamphlet

Patent document: JP Tokkaihei 5-104725A

Patent Document: JP Tokkaihei 5-278212A

Patent Document: JP Tokkaihei 6-134992A

Patent Document: JP Tokkai 2003-53977A

DISCLOSURE OF THE INVENTION

Problems to be Solved by the Present Invention

As a result of a study by inventors, in the liquid ejecting device where the electrostatic attraction method and the technology using pressure by distortion of the piezoelectric element or by creation of air bubbles in the liquid are combined, since a high voltage is applied between the liquid in the nozzle and the electrode opposed to the nozzle plate where the nozzle is formed, a surface opposed to the counter electrode of nozzle plate, namely an ejecting surface is charged. Thus it was noticed that for a maintenance period, after the high voltage is applied for liquid ejecting, while liquid ejecting is not carried out, discharging of the nozzle plate by ceasing application of the high voltage is necessary.

Thus, in case liquid ejecting and ceasing of liquid ejecting are repeated, if the discharging is not carried out while liquid ejecting is ceased, the next liquid ejecting cycle start under an effect of a record of charging of the nozzle plate in previous liquid ejecting. In case an isolation nozzle plate is used, attenuation of electric charge created by charging the surface while ceasing is very slow. Also, it is affected by environmental humidity because, if humidity is high, a surface resistance of the nozzle plate is decreased and electric charge maintaining ability is deteriorated. By such effect of the record, next charging can not be carried out appropriately. Thus since the electrostatic force applied to liquid in the nozzle cannot be an appropriate value, an amount of ejecting of liquid becomes excessively small or large.

Here, in the liquid ejecting apparatus to eject liquid to the substrate using the above electrostatic force, the substrate is charged, Therefore, in recent years, methods and apparatuses where ionic wind blows the substrate to discharge the substrate have been developed. It is also considered that using this method for the nozzle plate, the ionic wind blows the nozzle plate for discharging.

However, in this method where the ionic wind blows the nozzle plate, the liquid is dried up by bowing and harden at the ejecting port of the nozzle. Thus it is difficult to use such method to discharge the nozzle plate. Also in the discharging method of ionic wind, there is a problem that the nozzle plate cannot be discharged sufficiently.

Also, it is considered that a conductive brush or discharging member in shape of blade in contact with the nozzle plate are relatively moved for discharging.

However, in discharging, using the discharging member in shape of the brush, there are occurred portions in contact with the brush and not in contact with the brush on the ejecting surface of the nozzle plate, and uneven discharging occurs. Also, in discharging using the discharging member in shape of brush, if a particular portion of the nozzle plate is focused, the time length while being in contact with the blade is short and discharging is not always sufficient. To perform sufficient discharging, the blade has to be slid on the nozzle surface a plurality of times. In this method the discharging time is too long.

In case the nozzle plate is discharged unevenly, uneven charging is created in next charging and uneven electrostatic force, which is applied to the liquid in the nozzle, is created then liquid ejecting cannot be realized evenly. Also, if discharging is insufficient, appropriate charging cannot be carried out for next charging thus an amount of ejecting of liquid becomes excessively small or large.

Also, as FIG. 13 shows, in a liquid ejecting apparatus 1 using the electrostatic attraction method or the electric field assist method, since a positive voltage is applied to the liquid L in the nozzle 11 provided in the nozzle plate 12 and the counter electrode 3 is connected to the ground, the liquid L is charged positively, and a portion of the nozzle plate 12 in contact with the liquid L in the nozzle 11 is charged negatively.

Also, the ejecting surface 13 of the nozzle plate 12 is charged positively and a surface of the counter electrode 3 facing the nozzle plate 12 is charged negatively. In such charging state, the liquid L is ejected from the nozzle 11. Meanwhile, symbols in FIG. 13 and FIG. 14 are the same as the symbols in exemplary embodiments described later.

However, as FIG. 14 (A) shows, if the liquid L or dirt by foreign matters exist on the ejecting surface 13 of the nozzle plate 12, a portion of the ejecting surface of the nozzle plate 12 where the dirt is adhering is charged negatively. If discharging is carried out by the discharging member in shape of a blade or brush in such state, the dirt is difficult to be removed from the ejecting surface 13 because positive charge of the dirt and negative charge of the ejecting surface 13 attract each other. Thus as FIG. 14 (B) shows, the dirt charged positively spreads extensively on the ejecting surface 13.

Thereby, a wide area of the ejecting surface 13 is charge negatively, and as FIG. 14 (C) shows, even though charging of the liquid L in the nozzle 11 is attempted again so as to eject the liquid L, the liquid L charged positively spreads on the negatively charged portion of the ejecting surface 13, thus the meniscus of liquid L shown in FIG. 13 cannot be formed, and the liquid L cannot be ejected from the nozzle effectively.

Also, as FIG. 14 (A) shows, if the liquid L charged positively is adhering on the ejecting surface 13 near the ejecting port 14 on the nozzle plate 12, as FIG. 15 shows, the equipotential lines near the meniscus distort and the electric field at a meniscus front end becomes weak, as understood from comparison with FIG. 5 to be described, the electric field concentration becomes difficult to occur, thereby the liquid L cannot be ejected.

As above, there was found a problem that at maintenance of the liquid ejecting apparatus using electrostatic attraction method or electric field assist method, if the nozzle plate is discharged by the discharging member in shape of the blade or the brash, uneven discharging or insufficient discharging may be carried out and further, the dirt spreads on the ejecting surface of the nozzle plate then the charging state of the nozzle plate becomes abnormal, as a result, meniscus forming at the ejecting port of the nozzle is interfered.

Also, there was found the other problem that if the charged liquid is adhering on the ejecting surface of the nozzle plate 12, even though the meniscus of liquid L is formed at the nozzle 11, the electric field concentration is interfered and the ejecting of the liquid L cannot be performed appropriately.

Means to Solve the Problems

Therefore, an object of the present invention is to provide a liquid ejecting apparatus using the electrostatic method or the electric field assist method, where discharging of the nozzle plate is securely performed so as to enable appropriate ejecting of the liquid.

The liquid ejecting apparatus related to the invention of claim 1 is characterized in that the liquid ejecting apparatus, has an electrode; a liquid ejecting head, having; a nozzle plate including a nozzle opposed to the counter electrode to eject liquid, a charging electrode opposed to the counter electrode via the nozzle plate, and an electrostatic voltage applying device to apply an electrostatic voltage onto liquid in the nozzle; and a discharging device to discharge the charged nozzle plate; and a control device to control the electrostatic voltage applying device and the discharging device; wherein the discharging device provides a conductive discharging member contactable with an whole area of the nozzle plate opposed to the counter electrode.

According to the invention described in claim 1, the control device controls the electrostatic voltage applying device to apply the electrostatic voltage onto the liquid in the nozzle provided at the nozzle plate via the charging electrode of the liquid ejecting head and create a high voltage so as to eject the liquid from the nozzle. Also, the control device controls the discharging device so that the conductive discharging member, contactable with the whole area of the nozzle plate of the liquid ejecting head opposed to the counter electrode, contacts the whole area thereof and discharge the electric charge of the nozzle plate.

The liquid ejecting apparatus described in claim 2 is characterized in that the liquid ejecting apparatus, has: an electrode; a liquid ejecting head, having; a nozzle plate including a nozzle opposed to the counter electrode to eject liquid, a pressure generating device to rise a meniscus of liquid at a ejecting port of the nozzle, a charging electrode opposed to the counter electrode via the nozzle plate, and an electrostatic voltage applying device to apply electrostatic voltage to liquid in the nozzle; a discharging device to discharge the charged nozzle plate; and a control device to control the pressure generating device, the electrostatic voltage applying device and the discharging device; wherein the discharging device provides a conductive discharging member contactable with an whole area of the nozzle plate opposed to the counter electrode.

According to the invention described in claim 2, the control device of the liquid ejecting apparatus controls the pressure generating device to cause the meniscus of the liquid to rise at the ejecting port of the nozzle of the liquid ejecting head and controls the electrostatic voltage applying device to apply an electrostatic voltage onto the liquid in the nozzle provided at the nozzle plate via the charging electrode of the liquid ejecting head so that a high voltage is generated between the liquid in the nozzle and the counter electrode, and then ejects the liquid droplet in a way of tearing off. Also, the control device causes the conductive discharging member, which is detachable to the whole area of nozzle plate of the liquid ejecting head opposed to the counter electrode, to be in contact with the whole area thereof so as to discharge the electric charge of the nozzle plate.

In the liquid ejecting apparatus described in claims 1 or 2, the invention described in claim 3 is characterized in that the discharging member is formed with a porous material having interconnected cells.

According to the invention described in claim 3, the conductive discharging member formed with a porous material having interconnected cells is in contact with the nozzle plate to discharge.

In the liquid ejecting apparatus described in any one of claims 1 to 3, the invention described in claim 4 is characterized in that the discharging member is impregnated with liquid having conductive characteristic.

According to the invention described in claim 4, the conductive discharging member formed with a porous material having interconnected cells and impregnating conductive liquid is in contact with the nozzle plate to discharge.

In the liquid ejecting apparatus described in any one of claims 1 to 4, the invention described in claim 5 is characterized in that the volume resistivity of the nozzle plate is not less than $10^{15}$ Ωm.

According to the invention described in claim 5, the nozzle plate is formed with a material having the volume resistivity of not less than $10^{15}$ Ωm.

In the liquid ejecting apparatus described in any one of claims 1 to 5, the invention described in claim 6 is characterized in that the thickness of the nozzle plate is not less than 75 μm.

According to the invention described in claim 6, the nozzle plate is formed with a material having the thickness of the nozzle plate is not less than 75 μm.

In the liquid ejecting apparatus described in any one of claims 1 to 6, the invention described in claim 7 is characterized in that the inner diameter of an ejecting port of the nozzle is not more than 15 μm.

According to the invention described in claim 7, the nozzle is formed in a way that the inner diameter thereof is not more than 15 μm.

In the liquid ejecting apparatus described in any one of claims 1 to 7, the invention described in claim 8 is characterized in that the nozzle plate has a flat surface which is opposed to the counter electrode.

According to the invention described in claim 7, in the liquid ejecting apparatuses of electrostatic attraction method described in claim 1 or electric field assist method described in claim 2, the electric field converges at the liquid in the flat nozzle which is not protruding from the ejecting surface of nozzle plate of the liquid ejecting head opposed to the counter electrode.

In the liquid ejecting apparatus described in any one of claims 1 to 8, the invention described in claim 9 is characterized in that the control device controls the electrostatic voltage applying device so that the electrostatic voltage is applied onto the liquid in the nozzle after the nozzle plate is discharged by the discharging device.

According to the invention described in claim 9, the control device drives the electrostatic voltage applying device so as to charge the liquid in the nozzle after the nozzle plate of the liquid ejecting head is discharged.

Effect of the Invention

According to the invention described in claim 1, different from the conventional discharging members in shape of the brush or the blade, which creates uneven discharging among portions in contact with the brush and not in contact with the brush, the discharging member of the discharging device is the conductive discharging member which comes in contact with whole area of the ejecting surface of the nozzle plate, thus the conductive discharging member in contact with the whole area of the ejecting surface can thoroughly discharge the nozzle plate without such uneven discharge to occur.

Also, in case of the discharging member in shape of the brush or the blade, when a particular portion is focused, since the discharging member passes in a very short time, sufficient discharging cannot always be carried out. Thus it takes time to discharge by sliding the discharging member for a plurality of times. However, the discharging member of the present invention can perform sufficient discharging by contacting it onto the ejecting surface of the nozzle plate for a prescribed time, thus the discharging can be performed sufficiently and securely in a short time.

Further, since the discharging member does not slide on the ejecting surface of the nozzle plate, the dirt or the liquid adhering on the ejecting surface does not spread on the ejecting surface extensively thus interference of the meniscus forming of liquid can be prevented. Thus, according to the liquid ejecting apparatus of the present invention, the entire ejecting surface of the nozzle plate can be discharged sufficiently and securely by a conductive discharging member in contact with the entire ejecting surface of the nozzle plate. Thus the meniscus of liquid can be protruded appropriately at the ejecting port of the nozzle and the electric field can be converged when the liquid is ejected, thus the liquid can be ejected appropriately.

According the invention described in claim 2, besides in the liquid ejecting apparatus of the electrostatic attraction method where the liquid is ejected solely by the electrostatic attraction force between the liquid ejecting head and the counter electrode, the same effect can be realized in the liquid ejecting apparatus of the electric field assist method where the meniscus is risen at the ejecting port of the nozzle by applying pressure in the nozzle, and the liquid is ejected and then the meniscus is torn off by the electrostatic attraction force generated between the liquid ejecting head and the counter electrode so as to eject the liquid.

According the invention described in claim 3, since discharging is carried out by contacting the conducting discharging member formed with the porous material having interconnected bubbles with the nozzle plate, the dirt and liquid adhering on the ejecting surface of the nozzle plate can be absorbed by capillary action and removed from the ejecting surface, thus the effects described in each claim can be enhanced appropriately.

According the invention described in claim 4, since discharging is carried out by contacting the conducting discharging member formed with the porous material impregnating conductive liquid having interconnected bubbles with the nozzle plate, the dirt and liquid adhering on the ejecting surface of the nozzle plate can be resolved or dispersed into the conductive liquid and removed from the ejecting surface, thus the effect described in each claim can be enhanced appropriately.

According the invention described in claim 5, since the liquid ejecting apparatus described in claim 1 or 2, is configured with the nozzle plate formed with the material having the volume resistivity of $10^{15}$ Ωm, even though the electrostatic voltage applied to the liquid in the nozzle is low, the electric field can be converged effectively at the meniscus of liquid formed at the ejecting port of the nozzle, and the electric field intensity at the front end of the meniscus can be sufficient to eject the droplet of liquid effectively and stably, thus the liquid can be ejected for the miniaturized nozzle. In the above liquid ejecting apparatus, the effect described in each claim can be enhanced appropriately.

According the invention described in claim 6, in the liquid ejecting head described in each claim, since the nozzle is formed on the nozzle plate having the thickness of 75 μm, electric field conversion at the meniscus front end section occurs effectively, the electric field intensity at meniscus front end section can be more than $1.5\times10^7$ V/m which is required for stable liquid ejecting. In such liquid ejecting apparatus, the effects described in each claim can be enhanced appropriately.

According the invention described in claim 7, in the liquid ejecting head described in each claim, since the nozzle is form in the way that the inner diameter of the ejecting port is not more than 15 μm, electric field conversion at the meniscus front end section occurs effectively, the electric field intensity at meniscus front end section can be more than $1.5\times10^7$ V/m which is required for stable liquid ejecting. In such liquid ejecting apparatus, the effect described in each claim can be enhanced appropriately.

According the invention described in claim 8, since the electric field is converged to the liquid in flat nozzle which is not protruding from the ejecting surface of the nozzle plate of the liquid ejecting head opposed to the counter electrode, the nozzle plate has to be charged appropriately and the nozzle plate has to be appropriately charge, therefore the nozzle plate has to be securely discharged. By using the invention described in each claim, the liquid can be ejected appropriately even in such electric field conversion type liquid ejecting apparatus.

According the invention described in claim 9, the control device of the liquid ejecting apparatus thoroughly discharges the nozzle plate of the liquid ejecting head through the discharging device of the liquid ejecting apparatus described in claims 1 to 8, then applies the electrostatic voltage onto the liquid in the nozzle through the electrostatic voltage applying device. Thus after the nozzle plate is discharged sufficiently without having uneven charging, subsequent charging by applying the electrostatic voltage can be performed appropriate without having uneven charging. Therefore, when the liquid is ejected, the meniscus of liquid can be formed at the ejecting port section of the nozzle and the electric field can be converged, thus the liquid can be appropriately ejected and the effects described in each claim can be enhanced appropriately.

BRIEF DESCRIPTION OF THE DRAWINGS

FIG. 11 is a diagram showing an exemplary modification of a drive voltage applied to a piezoelectric element in a liquid ejecting apparatus of a first embodiment.

FIG. 14 (A) shows a state where dirt is adhering on a nozzle plate.

FIG. 14 (B) shows a state where dirt is spreading widely.

FIG. 14 (C) is a state where a meniscus is unable to be formed.

DESCRIPTION OF SYMBOLS

Figure 1:
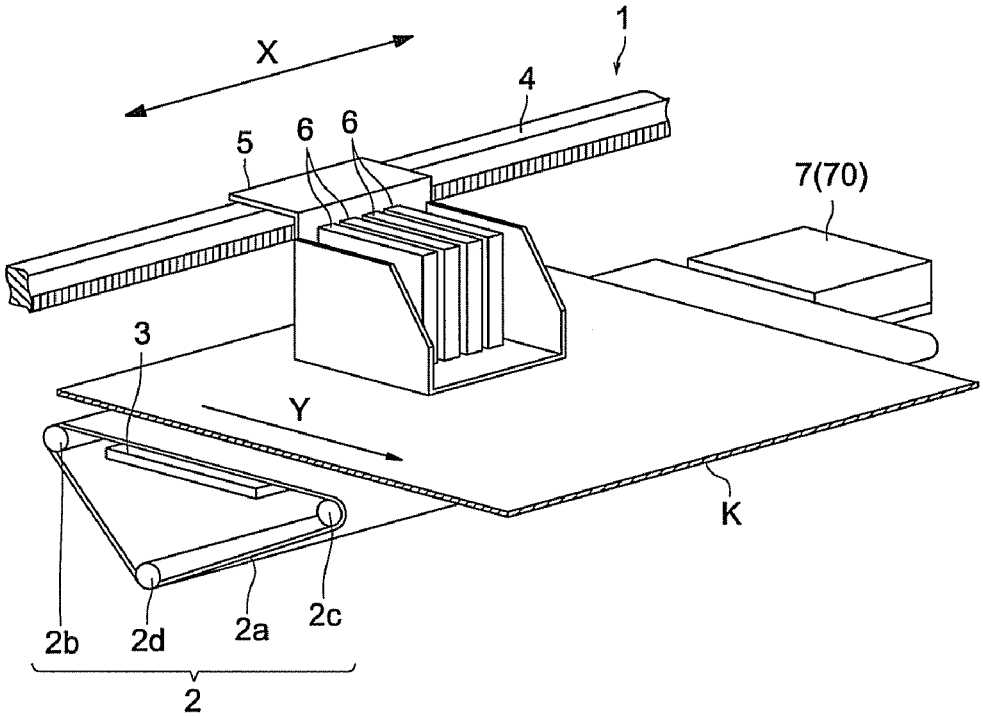
FIG. 1 is a perspective view showing a relevant structure of a liquid ejecting apparatus related to a first embodiment.

1: liquid ejecting apparatus
3: counter electrode
6: liquid ejecting head
7: discharging device
11: nozzle
12: nozzle plate
13: ejecting surface
14: ejecting port
17: charging electrode
19: electrostatic power source
23: piezoelectric element
25: control device
27: detachable device
70: discharging member
K: substrate
L: liquid

DETAILED DESCRIPTION OF THE PREFERRED EMBODIMENT

An embodiment of the liquid ejecting apparatus related to the present invention will be described with reference to the drawings as follow:

First Embodiment

In the first embodiment, so-called serial method liquid ejecting apparatus will be described. FIG. 1 is a perspective view showing a relevant structure of a liquid ejecting apparatus related to the first embodiment.

The liquid ejecting apparatus 1 is provided with a conveyance belt 2*a* in shape of endless loop configuring conveyance device 2 to convey a substrate K. With the conveyance belt 2*a*, a drive roller 2*b* to rotate and drive the conveyance belt 2*a*, a guide roller 2*c* and a tension roller 2*d* are in contact from inside, and the substrate K is supplied to a portion between the drive roller 2*b* and a guide roller 2*c* so as to be transferred to a conveyance direction shown by an arrow Y in the figure via the conveyance belt 2*a*.

Between the drive roller 2*b* and the guide roller 2*c*, a counter electrode 3 in shape of a flat bar which support the substrate K from a bottom via conveyance belt 2*a* is provided.

Above the counter electrode 3, a guide rail 4 in shape of a bar is disposed in a main scanning direction shown by an arrow X in the figure perpendicular to the conveyance direction of the substrate K. A carriage 5 is supported by the guide roller 4 in sliding manner along the guide rail 4 in the main scanning direction X.

On the carriage, a plurality of liquid ejecting heads to eject ink towards the substrate K are mounted. Four to eight liquid ejecting heads 6 are provide to correspond with respective colors yellow (Y), magenta (M), cyan (C) and Black (K). Also, to the liquid ejecting head 6, unillustrated ink tanks for respective colors to supply ink to the liquid ejecting head 6 are connected via unillustrated supply tubes.

At a maintenance position on one end side of the main scanning direction of the counter electrode 3, a discharging device 7 to discharge electric charge of the nozzle plate, which is described later, of the liquid head 6 is disposed, and the liquid ejecting head 6 is configured to move to a position above the discharging device 7 along the guide rail 4 in the main scanning direction at maintenance.

Figure 2:
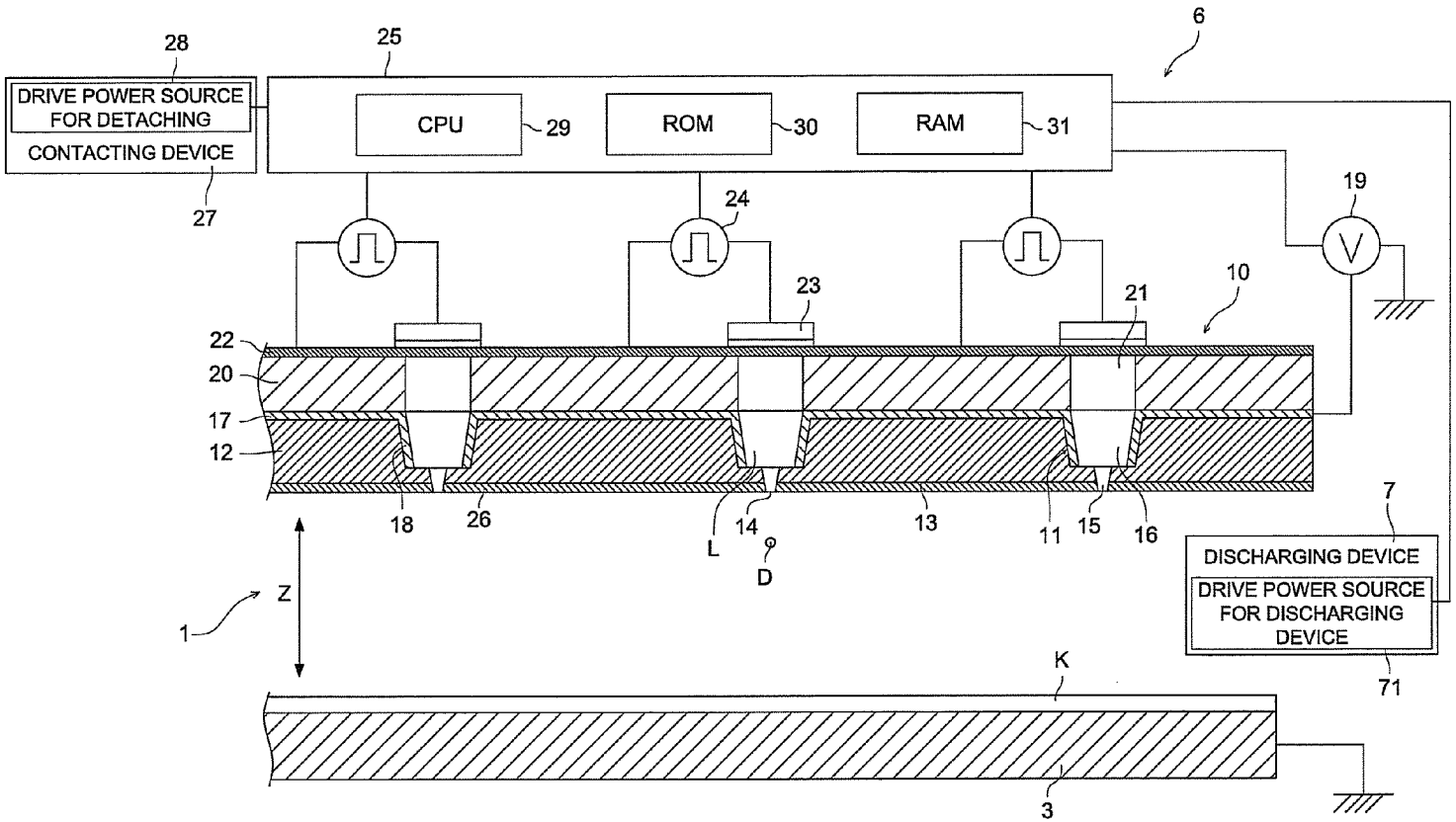
FIG. 2 is a cross-sectional view of a relevant portion of a liquid ejecting apparatus related to a first embodiment.

Next the liquid ejecting head 6 will be described. FIG. 2 is a cross-sectional view showing a total structure of the liquid ejecting apparatus related to the present invention. Meanwhile, the conveyance belt 2*a* is omitted in the FIG. 4.

On a side of the head main body section 10 of the liquid ejecting head 6 opposed to the counter electrode 3, the nozzle plate 12 formed with a resin having a plurality of nozzles 11 to eject liquid L as a droplet D is disposed. The head main body section 10 is configured as a head having so-called a flat ejecting surface 13 where the nozzles 11 are not protruding from the ejecting surface 13 opposed to the counter electrode 3 of nozzle plate 12.

Meanwhile, in the present invention, flat nozzle, flat nozzle plate or flat liquid ejecting head means that protrusion of the nozzles form the ejecting surface of the nozzle plate is not more than 30 μm, where the effect of electric field conversion cannot be expected since the protrusion of the nozzle is so small so that the problem such as damage does not occur when wiping.

Each nozzle formed by boring the nozzle plate 12, has a two stage structure where a small bore section 15 having an ejecting port 14 on the ejecting surface 13 of the nozzle plate 12 and a large bore section 16 having a larger bore formed behind the small bore section 15. In the present invention, each nozzle are configure that the small bore section 15 and large bore section 16 of the nozzle 11 have a circular cross-section respectively and formed in shape of taper where a counter electrode side has a smaller diameter. And a nozzle diameter of ejecting port 14 of small bore section 15, namely an inner diameter is loam and an inner diameter of an open end of the large bore section 16, which is most far side from the small bore section 15, is formed 75 μm.

Figure 3:
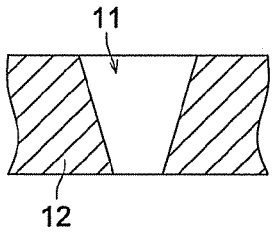
FIG. 3 is a cross-sectional view showing an exemplary modification of a nozzle provided in a liquid ejecting apparatus in FIG. 2.
Figure 3:
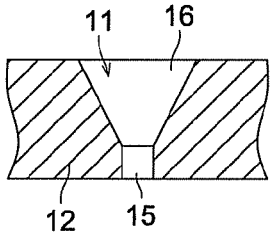
Figure 3:
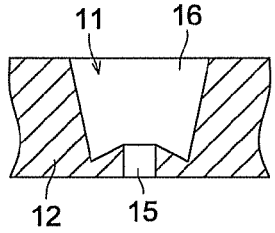
Figure 3:
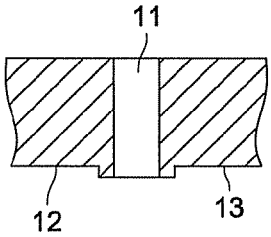
Figure 3:
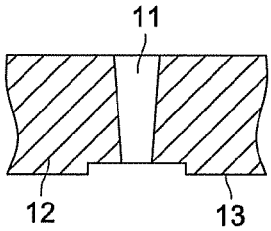

Meanwhile, the shape of the nozzle 11 is not limited to the shape thereof and, for example, shapes shown in FIG. 3 (A) to FIG. 3 (E) are exemplified. In FIG. 3 (A), entire nozzle is formed in an taper shape. In FIG. 3 (B), the large bore section 16 of the nozzle 11 is formed in the taper shape and the small bore section 15 is formed in a cylindrical shape where the inner diameter is unchanged. In FIG. 3 (C), the inner diameter of a front end section of the large bore section 16 in taper shape is formed to be larger than the inner diameter of the small bore section 15 in the cylindrical shape.

In FIG. 3 (D), the bore of nozzle 11 is formed in a cylindrical shape where the inner diameter is unchanged and the nozzle is formed to protrude slightly from the ejecting surface 13. In FIG. 3 (E), the entire nozzle is formed in the taper shape to be slightly recessed from the ejecting surface 13. Here. In FIG. 3 (D), the protruding section is formed to protrude from the ejecting surface 13 within a range of 30 μm. Also, the cross-section of the nozzle 11 can be a polygonal shape or a shape of star besides the circular shape.

On an opposite side of the ejecting surface 13 of the nozzle plate 12, as FIG. 2 shows, a charging electrode formed with a conductive material such as, for example, Nip are provided in a layer shape opposed to the counter electrode 3 via the nozzle plate 12. In the present embodiment, the charging electrode 17 is extended to the inner peripheral surface 18 of the large bore section 16 of the nozzle 11 so as to be in contact with the liquid L in the nozzle 11.

Also, the electrostatic power source 19, representing the electro static voltage applying device to apply the electrostatic voltage onto the liquid L in the nozzle 11, is connected to the charging electrode 17. Since one piece of charging electrode 17 is in contact with liquid L in all nozzles, when the electrostatic voltage is applied to the charging electrode 17 from the electrostatic power source 19, the liquid L in all nozzles are charged at the same time and the electrostatic attraction force is generated between the head main body 10 and the counter electrode 3, in particular between the liquid L and the substrate K.

Behind the charging electrode 17, body layer 20 is disposed. In a portion of the body layer 20 which faces to an end of opening of the large bore section 16, cavities in substantially cylindrical shape having a substantially the same inner diameter with the opening end are formed respectively, which are the cavities 21 to temporally reserve the ejected liquid L.

Behind the body layer 20, a flexible layer 22 formed with a thin metal plate or a silicon having flexibility is disposed so as to divide the head main body section 10 from outside by the flexible layer 22.

Meanwhile, in a border section between the body layer 20 and flexible layer 22, an unillustrated flow path is formed. Specifically, there is provided the cavity 21 formed by etching a silicon plate representing the body layer 20, common flow path, and a connection flow path connecting the common flow path and the cavity 21. The common flow path is communicated with an unillustrated supply tube to supply the liquid L from an unillustrated external liquid tank, and by an unillustrated supply pump provided at the supply tube or by a pressure difference created by a layout position of the liquid tank, a prescribed supply pressure is applied to the liquid L in the flow path, the cavity 21 and the nozzle 11.

Portions corresponding to respective cavities 21 at an outer surface of the flexible layer 22, the piezoelectric elements 23 representing pressure generating devices are provided respectively, and the piezoelectric element 23 is connected with the dive voltage power source 24 to apply a drive pulse to the element to distort the element.

The piezoelectric element 23 is distorted by applying the drive voltage from the drive voltage power source 24 and generates a pressure in the liquid L in the nozzle 11 so as to protorude the meniscus of the liquid L at the ejecting port 14 of the nozzle 11. Meanwhile, as the pressure generating device, besides the piezoelectric actuator in the present embodiment, for example, an electrostatic actuator or a thermal method can be used.

The electrostatic voltage power source 19 to apply the electrostatic voltage to the charging electrode 17 and the drive voltage power source 24 are connected to the control device 25 respectively and are controlled by the control device 25.

Meanwhile, in the present embodiment, on the entire ejecting surface 13 of the nozzle plate 12 of the head main body section 10, a liquid repellent layer 26 to suppress seeping out of the liquid L from the ejecting port 14 is provided except the ejecting port 14. For the liquid repellent layer 26, for example, a material having a water repellent characteristic is used if the liquid L is water-base and an oil repellent material is used if the liquid L is oil-base. In general fluororesins, such as FEP (6 4 ethylene fluoride and propylene fluoride), PTFE (poly tetrafluoro ethylene), fluorine siloxane, fluoro alkyl silane, and amorphous perfluoro resin are popularly used. They are formed into a film shape on the nozzle plate 12 by embrocation or an evaporation coating method. Meanwhile, the liquid repellent layer 26 can be formed by film forming directly onto the ejecting surface 13 of the nozzle plate 12 or to improve the adhesiveness, it can be formed via an intermediate layer.

Under the head main body section 10 of the liquid ejecting head 6, the counter electrode 3 in shape of flat plate to support the substrate K is disposed parallel to the ejecting surface 13 of the head main body section 10 distantly with a subscribed distance.

In the present embodiment, the counter electrode 3 is grounded and kept in a ground level voltage. Thus, when the electro static voltage is applied to the charging electrode 17 from the electrostatic power source 19, the electric field is created between the liquid L in ejecting port 14 of nozzle 11 and an opposing surface of the counter electrode 3 opposed to the head main body section 10. Also, when the charged droplet D lands on the substrate K, the counter electrode 3 discharges the electric charge to the ground.

Here, the liquid L ejected by the liquid ejecting apparatus 1 will be described. In the present invention, the liquid L is ink for image recording to record an image on the substrate K. For example, ink including water 52% by mass, ethylene glycol 22% by mass, propylene glycol 22% by mass, surface acting agent 1% by mass and CI acid read 1 3% by mass is used.

The liquid L is not limited to the above ink and various kinds of liquid L can be used. For example, fro inorganic solutions for ejecting liquid L such as water, $COCl_2$, HBr, $HNO_3$, $H_3PO_4$, $H_2SO_4$, $SOCl_2$, $SO_2Cl_2$, and $FSO_3H$ are exemplified.

Also as an organic liquid, Alcohols such as methanol, n-propanol, isopropanol, N-butanol, 2-methyl-1-propanol, tert-butanol, 4-methyl-2-pentanol, benzyl alcohol, alpha-terpineol, ethylene glycol, glycerol, diethylene glycol, and triethylene glycol; Phenols such as o-cresol, m-cresol, and p-cresol; Ethyl such as dioxane, furfural, ethylene ethyleneglycol dimethyl ether, methyl cellosolve, Ethyl cellosolve, butyl cellosolve, ethyl carbitol, butyl carbitol, Ethers, such as butyl Carbitol acetate and epichlorohydrin; Ketones such as acetone, methyl ethyl ketone, 2-methyl 4-pentanone, and acetophenone; Fatty acid such as formic acid, acetic acid, dichloroacetic acid, and trichloroacetic acid; Esters such as methyl formate, ethyl formate, methyl acetate, ethylacetate, acetic acid-n-butyl, isobutyl acetate, acetic acid-3-methoxy butyl acetic acid-n-pentyl, ethyl propionate, ethyl lactate, methyl benzoate, diethyl malonate, dimethyl phthalate, diethyl phthalate, diethyl carbonate, Ethylene carbonate, propylene carbonate, Cellosolve acetate, butyl Carbitol acetate, ethyl acetoacetate, methyl cyanoacetate, and cyano ethylacetate; Azotic compounds, such as nitromethane, Nitrobenzene, acetonitrile, propionitrile, succinonitrile, バレロnitrile, benzonitrile, ethylamine, diethylamine, Ethylenediamine, aniline, N-methylaniline, N,N dimethylaniline, Ortho toluidine, para toluidine, piperidine, pyridine, the alpha-picoline, 2,6-lutidine, quinoline, propylenediamine, formamide, N-methyl formamide, N,N dimethylformamide, N,N-diethyl formamide, Acetamide, N-methyl acetamide, N-methyl propione amide, N,N,N',N'-tetramethylurea, and N-methylpyrolidone; Sulfur containing compounds such as Dimethyl sulfoxide, a sulfolane; hydrocarbon such as benzene, p-cymene, naphthalene, cyclohexylbenzene, and cyclohexene, Halogenated hydrocarbon, such as 1,1-dichloroethane, 1,2-dichloroethane, 1,1,1-trichloroethane, 1,1 and 1,2-tetrachloroethane, 1,1,2,2-tetrachloroethane, pentachloroethane, 1,2-dichloroethylene (cis-), tetrachloroethylene, 2-chloro butane, 1-chloro 2-methylpropane, 2-chloro 2-methylpropane, bromomethane, tribromomethane, and 1-bromo propane, are cited. Moreover, two or more sorts of the above-mentioned liquid may be mixed and used.

Further, when a conductive past including a large amount of high electric conductive material (for example silver powder) is used as liquid L for ejecting, object substances to be solved or dispersed in the aforesaid liquid L, are not limited, except for a large particle substance may cause clogging.

PDP, CRT and FED widely known as fluorescent substance, can be used without limitation in particular. For example, as red color fluorescent substances $(Y,Gd)BO_3$:Eu, $YO_3$:Eu, as green color fluorescent substances $n_2SiO_4$:Mn, $BaAl_{12}O_{19}$:Mn, (Ba,Sr,Mg)Oα-$Al_3O_3$:Mn and as blue color fluorescent substances $BaMgAl_{14}O_{23}$:Eu,$BaMgAl_{10}O_{17}$:Eu are exemplified In order to adhere the above-mentioned objective substance firmly on a base material, it is preferable to add various binders. As a binder to be used, for example, Ethyl cellulose, Cellulose and cellulose derivative such as methyl cellulose, a CN, a cellulose acetate, and hydroxyethyl cellulose, Acryl resin (meth) and its metal salt, such as alkyd resin of those; The poly meth KURITA krill acid, Polymethylmethacrylate, 2-ethylhexyl methacrylate methacrylic acid copolymer, a lauryl methacrylate 2-hydroxyethyl methacrylate copolymer; Poly (meth)acrylamide resin, such as Poly N-isopropyl acrylamide, poly N,N-dimethylacrylamide; Styrene resin such as polystyrene, an acrylonitrile styrene copolymer, the styrene maleic acid copolymer, and a styrene isoprene copolymer; Styrene acryl resin such as styrene and a n-butyl methacrylate copolymer; Various polyester resin of saturation and unsaturation; Polyolefine series resin such as polypropylen; Halogenation polymers, such as polyvinylchloride and a PVDC Vinyl resin, such as a polyvinyl acetate and a pvca polyvinyl chloride acetate; polycarbonate resin; epoxy-system-resin; polyurethane series resin; Polyacetal resin, such as polyvinyl formal, a PVB and a polyvinyl acetal, Polyethylene series resin such asethylene, an ethylene-vinylacetate copolymer, ethyl acrylate copolymer resin; Amide resin such as benzoguanamine; Urea resin; Polyvinyl-alcohol-resin and its anion cation denaturation; Polyvinyl pyrrolidone and its copolymer; Alkylene oxide homopolymers, a copolymer and a cross linkage object such as polyethylene oxide carboxylation polyethylene oxide; Polyalkylene glycol such as polyethylene glycols and polypropylene glycol; polyether polyol; SBR, NBR latex; dextrin; sodium alginate; Nature or semi-synthetic resin such as gelatin and its derivative, casein, Abelmoschus manihot, tragacanth gum, pullulan, a gum arabic, Locust bean gum, guar gum, pectin, carrageenin, a glue, albumen, various starch, cornstarch, konnyaku, seeweed base glue, agar, and soy protein; terpene resin; ketone resin; rosin, and rosin ester; polyvinyl methyl ether; polyethyleneimine; polystyrene sulfonic acid; Polyvinyl sulfonic acid etc. can be used. These resins can be used not only as a homopolymer but a mixture in which the resins are blended in a range where they can be dissolved each other.

In case the liquid ejecting device 1 is used as a patterning devices a display us is representative. Specifically, forming of a fluoresce substance of a plasma display, forming of a plasma display rib, forming of an electrode of plasma display, forming of fluorescent substance of CRT, forming of fluorescent substance of FED (field ejecting type display), forming of rib for FED, color filter for liquid crystal display (RGB coloring layer, black matrix), and spacer for liquid crystal display (pattern and dot corresponding to black matrix).

Meanwhile, the rib generally means a barrier, and taking the plasma display as an example, it is used to separate a plasma area of each color. As other usages; patterning embrocation such as a micro lens, for semiconductor use, a magnetic substance, a ferroelectric substance, and a conductive past (wiring and antenna); graphic usage such as ordinary printing, printing on special medium (film, textile and steel plate), printing on a curved surface, printing on various printing plates; fabrication usage such as embrocation of a cohesive material and a sealing material using the present invention; and bio and medical usages such as embrocation of a medicinal chemical (where a plurality of minute amount of components are mixed) and a gene diagnosis sample.

Meanwhile, the liquid ejecting apparatus 1 provides a detaching device 27 which detaches and attaches the nozzle plate 12 and the counter electrode 3 relatively by moving at least the nozzle plate 12 or the counter electrode 3 in a direction shown by an arrow Z in FIG. 2 perpendicular to the ejecting surface. Namely, the detaching device 27 is to adjust the distance between the nozzle plate 12 and the substrate K.

The detaching device 27 provides a widely known moving mechanism of which detaching mechanism drive power source 28 representing a drive source is electrically connected with the control device 25 so as to be driven by control of the control device 25.

Figure 4:
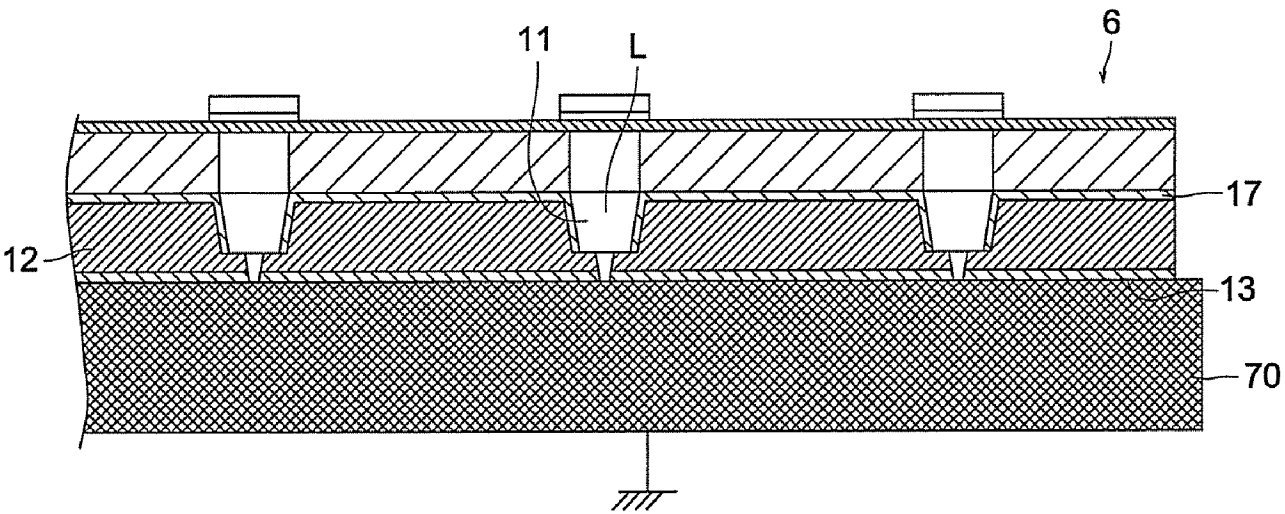
FIG. 4 is a cross-sectional view describing a state where a discharging member is in contact with a nozzle plate.

The discharging device 7 described above at the maintenance position is provided with a discharging member 70 and a discharging drive power source 71 representing a dive power source. As FIG. 4 shows, by driving of the discharging drive power source 71, the discharging member 70 comes in contact with the whole area of the ejecting surface 13 of the nozzle plate 12. The discharging drive power source 71 of the discharging device 7 is electrically connected with the control device 25 so as to be controlled based on control of the control device 25.

In the present embodiment, the discharging member 70 is configured with a porous resin material formed in a shape of a flat plate having spongelike interconnected bubbles impregnating conductive liquid. Also, the discharging member 70 is grounded. Meanwhile, it can be configured with the porous material having conductive characteristics and with a conductive plate shape member such as a metal plate not having the bubbles.

Meanwhile, the conductivity of the discharging member is not limited as far as the electric charge of the nozzle plate can be discharged, however the volume resistivity of not more than $10^{10}$ is preferred.

In the present embodiment, the control device 25 is configured with a computer where CPU 29, ROM 30 and RAM 31 are connected to an unillustrated bus. The CPU 29 drives the electro static voltage power source 19 representing the electrostatic voltage applying device and the drive voltage power source 24 to distort the piezoelectric element 23 based on a power source control program stored in the ROM 30 so that the liquid L is ejected from the nozzle 11.

Also, the control device 25 controls a detaching drive power source 28 of the detaching device 27 and discharging drive power source 71 of the discharging device 7 so as to drive the discharging drive power source 71 to cause the discharging member 70 to come in contact with the nozzle plate 12 to discharge the nozzle plate 12, thereafter the control device 25 drives the electrostatic voltage power source 19 to charge the liquid in the nozzle.

To the control device 25, a motor to reciprocate the carriage 6 in the main scanning direction, a motor to rotate and drive the drive roller 2*b* of the conveyance device 2 are electrically connected. The control device 25 controls driving of these motors. The illustrations are omitted.

Also, in the present embodiment, the control device 25 actually performs printing on the substrate K by ejecting liquid so as to detect ejecting failure of the nozzle 11 of the liquid ejecting head 6 by visual observation. In addition, there can be a configuration where a light transmission/reception device having a liquid receiver and LED, is disposed at the maintenance position and the liquid is ejected from the nozzle 11 of the head 6 then whether or not the liquid is correctly ejected is detected by the light transmission/reception device so as to detect a defective nozzle.

Here, electrostatic voltage V applied between the charging electrode and the counter electrode, namely between the liquid in the nozzle and the counter electrode in the liquid ejecting apparatus 1 of the present embodiment will be described which is described in details in the Patent Document 1.

Being given that the diameter of the nozzle 11 is D m, in the present invention, ejecting of a liquid droplet in an area which has been deemed to be impossible defined by the following expression (2), is performed.

[Numeral 1]

$$d < \frac{\lambda_c}{2} \tag{1}$$

Here λc is a growth wavelength[m] at a solution liquid surface which enables ejecting of the droplet from the nozzle front end section by an electrostatic attraction force. Because λc can be obtained by $\lambda c = 2\pi\gamma h^2/\epsilon_0 V^2$:

[Numeral 2]

$$d < \frac{\pi\gamma h^2}{\varepsilon_0 V^2} \tag{2}$$

the above expression becomes true. Then by transforming it, the electrostatic voltage V[V]

[Numeral 3]

$$V < h\sqrt{\frac{\pi\gamma}{\varepsilon_0 d}} \tag{3}$$

satisfies the above relation. Here, γ represents surface tension [N/m] of the liquid L, $\epsilon_0$ is a permittivity [F/m] of vacuum, h is a distance between the nozzle and the substrate [m].

On the other hand, being given that a conductive solution is injected to a nozzle having a diameter d, and the nozzle is position vertically having a height h from a unlimited flat plate conductive substance representing a substrate, provided that the electric charge inducted at the front end of the nozzle section is converged at hemisphere section on nozzle front end, the following expression approximately expresses the electric charge.

[Numeral]

$$Q = 2\pi\epsilon_0 \alpha V d \tag{4}$$

Here, Q is the electric charge [C], inducted at nozzle front end section, α is a constant of proportion which value is 1 to 1.5 and will be around 1 particularly in case of d<<h, depending on a shape of the nozzle, Also, in case the substrate representing base material is conductive, it is deemed that a mirror image electric charge Q' having opposite polarity is inducted at a symmetric position in the substrate. In case the substrate is an isolation substance, an image electric charge Q' having an opposite polarity is inducted at a symmetrical position determined by the permittivity in the same manner.

Meanwhile, being given that a curvature radius of the front end section of the meniscus in a shape of a convex is R [m], the electric field intensity $E_{loc}$ [V/m] at front end of the meniscus in a shape of a convex at the front end of nozzle is

[Numeral 5]

$$E_{loc} = \frac{V}{kR} \tag{5}$$

given. Here k is a constant of proportion which value is deemed to be 1.5 to 8.5 depending on the shape of the nozzle and in many cases it is around 5. (refer to P. J. Birdseye and D. A. Smith, Surface Science, 23 (1970) 198-210).

For simplicity, d/2=R is give. This is equivalent to a state where the conductive solution is rising in a shape of a hemisphere having the same radius as that of the nozzle by the surface tension at the front end section of the nozzle. Here, a balance of pressure applied to liquid at the front end of the nozzle is considered. First, given that a liquid area at the front end section of the nozzle is S[$m^2$], electro static pressure is

[Numeral 6]

$$P_e = \frac{Q}{S}E_{loc} \approx \frac{Q}{\pi d^2/2}E_{loc} \tag{6}$$

according to the expressions (4), (5) and (6), given that α=1

[Numeral 7]

$$P_e = \frac{2\varepsilon_0 V}{d/2} \cdot \frac{V}{k \cdot d/2} = \frac{8\varepsilon_0 V^2}{k \cdot d^2} \tag{7}$$

expressed as above.

On the other hand, given that the surface tension of the liquid at the front end section of the nozzle is Ps, the following expression (8) becomes true.

[Numeral 8]

$$P_s = \frac{4\gamma}{d} \tag{8}$$

A condition where ejecting of liquid L by the electrostatic force occurs is the condition where the electrostatic force exceeds the surface tension. Thus $$P_e > P_s \tag{9}$$

is true, and using a sufficiently small nozzle diameter d, the electro static force can exceed the surface tension.

From the above relational expressions, V and d are obtained.

[Numeral 10]

$$V > \sqrt{\frac{\gamma k d}{2\varepsilon_0}} \tag{10}$$

The above expression gives a minimum voltage of ejecting. Thus from the expression (3) and (10),

[Numeral 11]

$$h\sqrt{\frac{\gamma\pi}{\varepsilon_0 d}} > V > \sqrt{\frac{\gamma k d}{2\varepsilon_0}} \tag{11}$$

the above voltage is an operation voltage of the present invention.

Next operation of the liquid ejecting apparatus 1 related to the present embodiment will be described.

Figure 13:
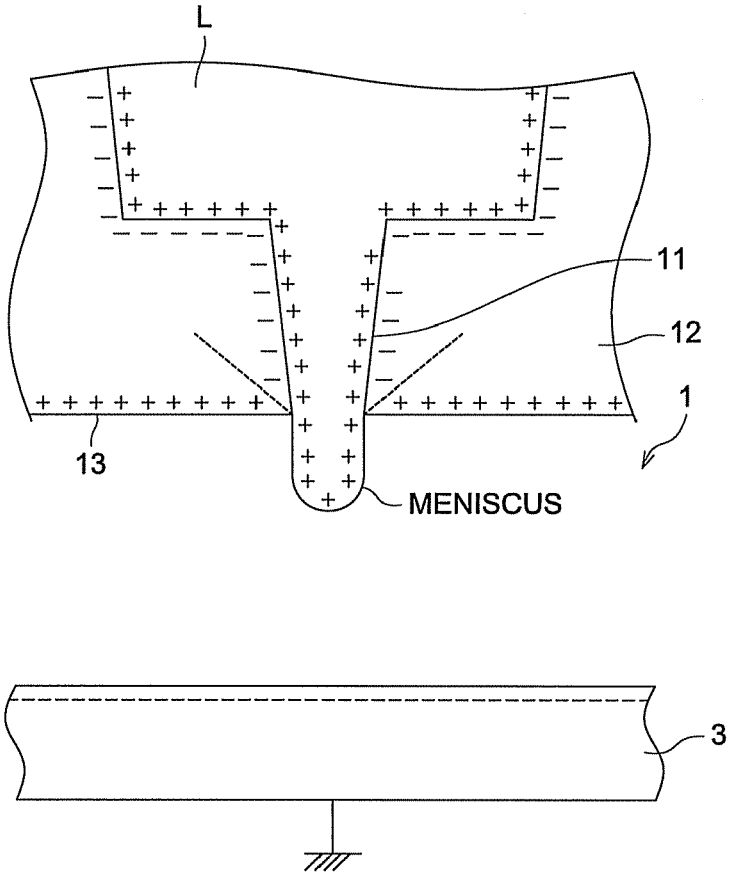
FIG. 13 is a diagram describing a charging state of a nozzle plate, liquid and a counter electrode.
Figure 15:
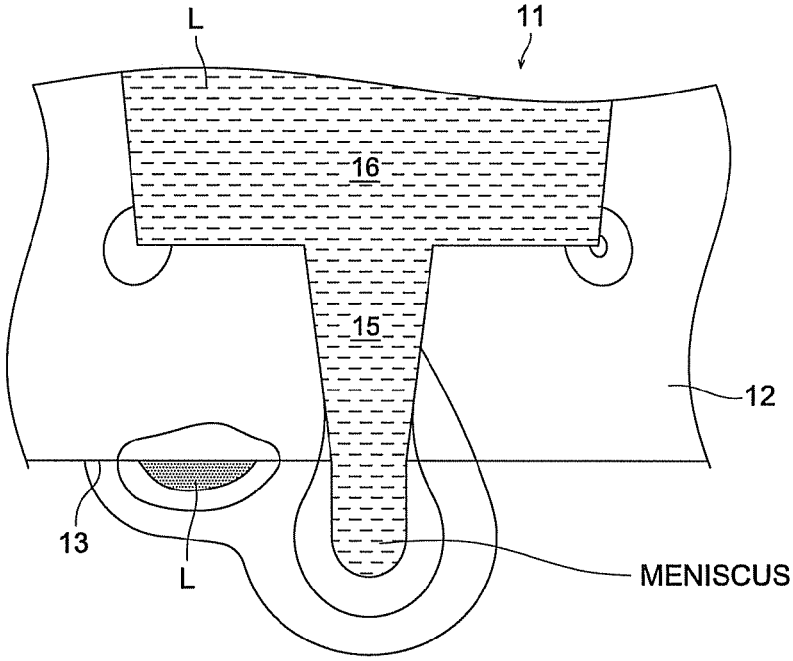
FIG. 15 is a diagram describing that equipotential lines are distorted by dirt adhering near an ejecting port.

In the embodiment, as FIG. 2 and FIG. 13 show, the drive voltage power source 24 applies a drive voltage to the piezoelectric element 23 to distort the piezoelectric element 23, thereby the meniscus of the liquid L is risen by the pressure created in the liquid L through the distortion of the piezoelectric element 23 at the ejecting port 14 of the nozzle 11, then electrostatic voltage is applied from the electrostatic power source 19 to the charging electrode 17 so as to create the electric field between the meniscus at the ejecting port 14 of nozzle 11 and the opposite surface of the counter electrode oppose to the head main body section 10.

As above, by applying the electrostatic attraction force onto the meniscus of the liquid L, the liquid droplet is created and ejected towards the counter electrode 3. Meanwhile, when ejecting, the inner portion of the nozzle 11, the liquid L in the nozzle 11, the meniscus, the ejecting surface 13 of the nozzle plate 12 and the counter electrode 3 are charged as FIG. 13 shows.

Figure 5:
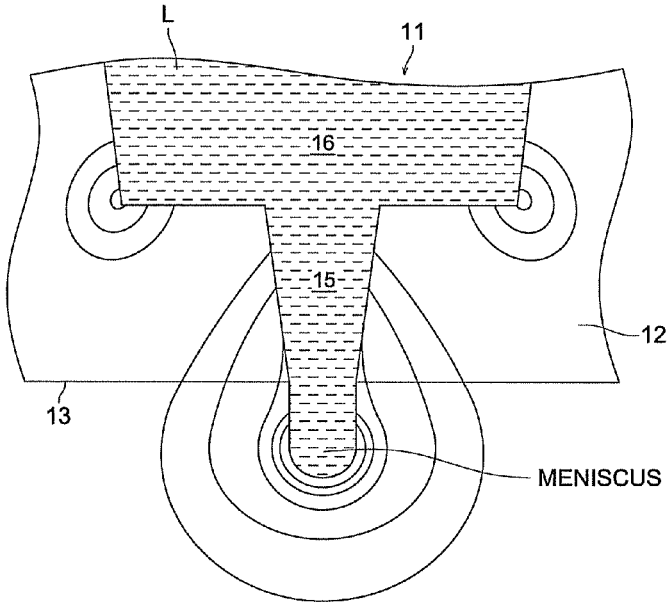
FIG. 5 is a diagram where an electric field generated at a front end of a meniscus of liquid is shown by equipotential lines.

Specifically, in the present invention, the volume resistivity of the nozzle plate 12 is not less than $10^{15}$ Ωm, thus as the equipotential lines by simulation show in FIG. 5, because the volume resistivity is high, the equipotential lines lay substantially vertical in respect to the ejecting surface 13 inside the nozzle plate 12, and a strong electric field towards the meniscus section of the liquid L or the liquid L in the small bore section 15 of the nozzle 11 is created.

In particular, as the high density equipotential lines at front end of the meniscus indicate, a strong electric field is created at the front end section of the meniscus. Thus the meniscus is torn off by the electrostatic force of the electric field and separated from the liquid L in the nozzle to be a droplet. Further the droplet D is accelerated by the electrostatic force and attracted to the substrate K supported by the counter electrode 3 so as to land on it. At this moment, since the droplet tents to land on a nearer place by an affect of the electrostatic force, a landing angle in respect to the substrate K becomes stable and accurate.

In this way, using the ejecting principle of the liquid L in the liquid ejecting head 6 of the present invention, even with the liquid ejecting head 6 having a flat ejecting surface 13, using the nozzle plate having the high electric isolation, a strong electric field concentration can be realized by generating voltage potential difference in a vertical direction in respect to the ejecting surface 13, thus a stable and accurate ejecting conditions of the liquid L is realized.

In an experiment carried out by the inventors where the nozzle plate 12 is formed with various kinds of isolation substances and configured so that the electric field intensity of the electric field between the electrodes becomes to be a practical value of 1.5 kV/mm based on the following experimental conditions, there were the cases where the droplet D was ejected and was not ejected.

[Experimental Conditions]

A distance between the ejecting surface 13 of the nozzle plate 12 and the opposing surface of the counter electrode 3: 1.0 mm A thickness of the nozzle plate 12: 125 μm A nozzle diameter: 10 μm A electrostatic voltage: 1.5 kV A drive voltage: 20V In the experiment using an actual apparatus, the electric field intensity at the front end section of the meniscus. In practice, since it is difficult to measure the electric field intensity directly, the intensity thereof is calculated by simulation by an electric field simulation software of "PHOTO-VOLT" (trade name) manufactured by Photon Co., Ltd. in an electric current distribution analysis mode. As a result, the electric field intensity at the meniscus front end section was not less than 1.5 $10^7$ V/m (15 KV/mm).

Figure 6:
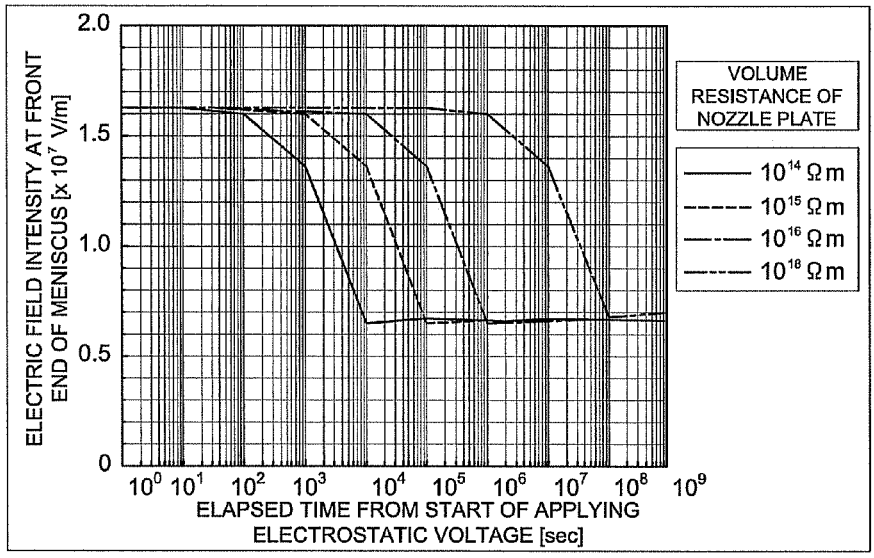
FIG. 6 is a graph showing a relationship between electric field intensity at a front end of a meniscus and a volume resistivity rate of a nozzle plate.

Also, as a result of calculation of the electric field intensity at the meniscus front end section by the aforesaid software where the same parameter as the aforesaid experiment was inputted, as FIG. 6 shows, there was found an evidence that the electric field intensity is heavily depend on the resistivity of the nozzle plated 12 in used. In FIG. 6, change of the electric field intensity at the meniscus front end after starting application of the electrostatic voltage is calculated, being given that the volume resistivity of the isolation substance is $10^{14}$ Ωm to $10^{18}$ Ωm. In this calculation since the volume resistivity of air had to be set, $10^{20}$ Ωm was set. According to the FIG. 6, by ionic polarization of the isolation substance used for the nozzle plate 12, in case the volume resistivity of the substance thereof is $10^{14}$ Ωm, the electric field intensity at the meniscus front end section has decreased by large amount, 100 seconds after the electrostatic voltage was applied. The time period from start of application of the electrostatic voltage to the start of decreasing of the electric field at the meniscus front end section is determined by a proportion between the volume resistivity of air and the volume resistivity of the isolation substance used for the nozzle plate 12. Thus as the volume resistivity of the isolation substance used for the nozzle plate 12 increases, starting of decrease of the electric field intensity at the meniscus front end delays. Thus the time to maintain necessary electric field intensity becomes longer which is preferable.

In documents, the isolation substance often means the inductive substance having the volume resistivity of not less than $10^{10}$ Ωm, and polysilicate glass (for example, PYREX (registered mark) known as a representatives of the isolation substance has the volume resistivity of $10^{14}$ Ωm.

However, the electrostatic attraction force of the isolation substance having such volume resistivity is weak. It is presumed that this is because before or during the failure of ejecting is being evaluated, the intensity the electric field decreases and the necessary intensity cannot be obtained. Meanwhile, a case where $10^{20}$ Ωm is assigned to the volume resistivity with reference to the time required for evaluation of ejecting failure and observing time has met with the result of experience. Once the intensity of the electric field at meniscus front end section decreased the ionic polarization of the isolation substance used in the nozzle plate 12 has to be discharged to be returned to an initial condition. As described above, to eject the droplet D form the nozzle 11 stably, the intensity of electric field at the meniscus front end section has to be not less than $1.5\times10^7$ V/m, and as FIG. 6 shows, the volume resistivity of the nozzle plate 12 is preferred to be not less than $10^{15}$ Ωm by which the intensity of the electric field at the meniscus front end section can be maintained at least for 1000 seconds. This equated to the result of the experiment. Meanwhile, in the present invention, the volume resistivity is not limited to the volume resistivity thereof.

The reason of the peculiar relationship between the volume resistivity of the nozzle plate 12 and the intensity of electric field at the meniscus front end section is presumed that if the volume resistivity of the nozzle plate 12 is low, when the electrostatic voltage is applied, the equipotential lines in the nozzle plate do not lay perpendicular in respect to the ejecting surface 13 as FIG. 5 shows, thus sufficient conversion of the electric field at the meniscus of liquid L and the liquid L in the nozzle cannot be realized.

In theory, even in the nozzle plate having the volume resistivity of less than $10^{15}$ Ωm, by increasing the electrostatic voltage extremely, there is a possibility that the droplet D is ejected from the nozzle, however there is a possibility that the substrate K is damaged by park between the electrodes, thus use of the nozzle plate having the volume resistivity of not less than $10^{15}$ Ωm is preferred.

Meanwhile, the peculiar dependency relation of the intensity of the electric field at the meniscus front end section in respect to the volume resistivity of the nozzle plate 12 is also obtained in a simulation where the nozzle diameter was varied. In any case, it is know that if the volume resistance is not less than $10^{15}$ Ωm, the intensity of the electric field at the meniscus front end section becomes not less than $1.5\times10^7$ V/m. Also, in case of the present invention, the thickness of the nozzle within the experimental conditions is equal to a sum of lengths of small bore section 15 and large bore section 16 of the nozzle 11.

On the other hand, though the nozzle plate 12 is formed with a substrate having the volume resistivity of not less than $10^{15}$ Ωm, there is a case where the droplet D is not ejected. According to an experiment carried out by the inventors, in the experiment where liquid having conductive solvent such as water was used as the liquid L, it was found that a liquid absorption rate of the nozzle plate 12 has to be not more than 0.6%.

It is with this thought that if the nozzle plate 12 absorbs a conductive solvent from the liquid L, a molecule such as molecule of water, which is conductive liquid, exists in the nozzle plate. Thus as a result, an electric conductivity of the nozzle plate 12 increases electric conductivity and decrease an effective volume resistivity of a local area in contact with the liquid L in particular, thus the intensity of the electric field at the meniscus front end section decreases in accordance with a relation shown in FIG. 5, consequently converge of the electric field necessary for ejecting of the liquid L is not obtained.

Contrarily, according to the experiment, it is found that in case liquid where chargeable particles are dispersed in an isolating solvent not including a conductive solvent is used as the liquid L, the nozzle plate 12 can eject the liquid L irrespective of the absorption rate of the liquid, if the volume resistivity is not less than $10^{15}$ Ωm. It is with this thought that since the electric conductivity of the isolating solvent is low, even if the isolating solvent is absorbed by the nozzle plate 12, the electric conductivity of the nozzle plate 12 does not change excessively and the effective volume resistivity does not decrease.

Meanwhile, the chargeable particle dispersed in the isolating solvent does not increase the electric conductivity of the nozzle plate 12, for example, even if the particle is a very large metal particle, since it is not absorbed by the nozzle plate 12. Here the isolating solvent is a solvent which cannot be ejected by the electrostatic attraction force by itself. Specifically, for example, xylene, toluene and tetradecane are exemplified. Also, the electric conductive solvent means a solvent having the electric conductivity of not less than $10^{-10}$ S/cm.

Figure 7:
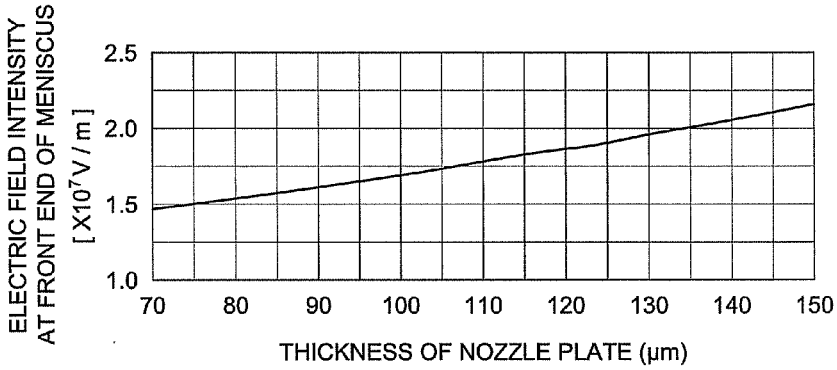
FIG. 7 is a graph showing a relationship between electric field intensity at a front end of a meniscus and a thickness of a nozzle plate.
Figure 8:
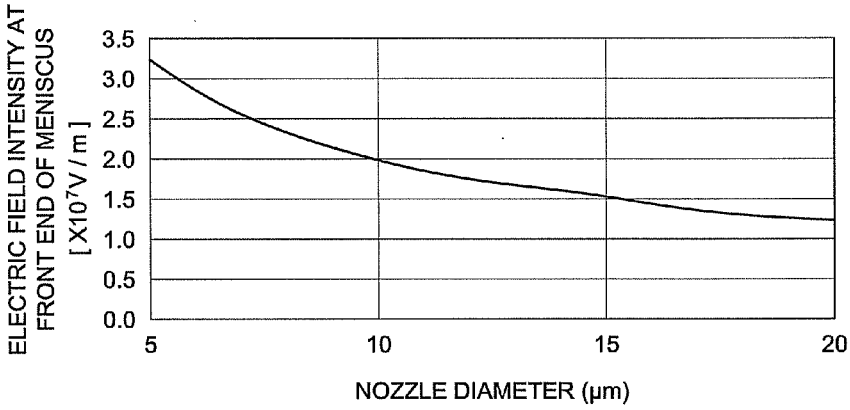
FIG. 8 is a graph showing a relationship between electric field intensity at a front end of a meniscus and a diameter of a nozzle.

Also, in the above simulation, the intensities of the electric field at the meniscus front end section, in case the thickness of the nozzle plate 12 is varied and the nozzle diameter is varied, are shown respectively in FIG. 7 and FIG. 8. From this result, the intensity of the electric field at the meniscus front end section depends on the thickness of the nozzle plate 12 and the nozzle diameter which are preferred to be not less than 75 μm and not more than 15 μm respectively. Meanwhile, the aforesaid appropriate ranges of the thickness of the nozzle plate 12 and the nozzle diameter are confirmed by experiment using the actual apparatus.

Meanwhile, the nozzle diameter is an inner diameter of the ejecting port of the nozzle and a shape of a cross section of the nozzle is not restricted by a circular shape and cross sections in various kinds of shapes can be used. For example the cross section of the nozzle can be formed in a shape of a polygon or a star instead of the circular shape. Here, in case the cross section is not in the circular shape, the diameter of the cross section means a diameter of a circular cross section having the same cross-sectional area as that of the subjected cross section.

As a reason that the intensity of the electric field at the meniscus front end section depends on the thickness of the nozzle plate 12, it is thought that since a distance between the ejecting port 14 of the nozzle 11 and the charging electrode 17 increases as the thickness of the nozzle plate 12 increases, the equipotential lines in the nozzle plate readily lay substantially perpendicular, thereby conversion of the electric field at the meniscus front end section is readily created.

Also, by making the nozzle diameter small, the diameter of the meniscus becomes small, thus since the electric field is converged at the smaller meniscus front end section, the degree of conversion increases. Thus the intensity of the electric field at the meniscus front end section becomes higher.

Meanwhile, the relationship between the thickness of the nozzle plate 12 and the intensity of the electric field at the meniscus front end section shown in FIG. 7 and the relationship between the nozzle diameter and the intensity of the electric field at the meniscus front end section shown in FIG. 8 has been obtained, not only in case of the nozzle having two-stage structure configured with small bore section 15 and large bore section 16 in the present invention but in case of an one-stage structure, namely a nozzle in a shape of a simple taper or a shape of a cylinder, or multi stage nozzle in a similar simulation result.

Figure 9:
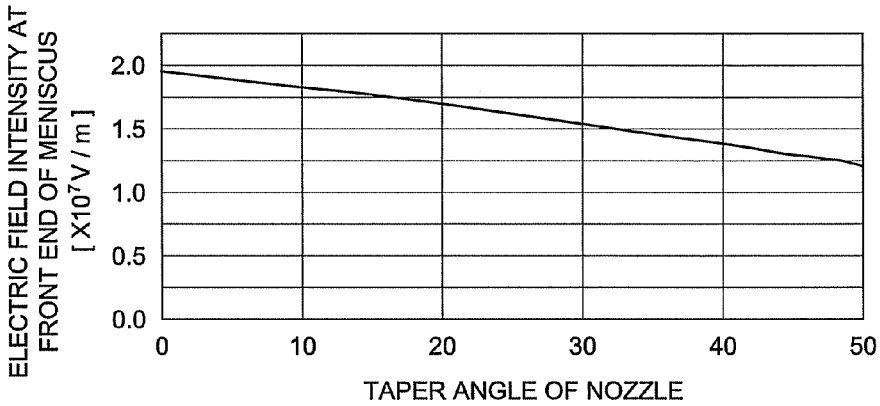
FIG. 9 is a graph showing a relationship between electric field intensity at a front end of a meniscus and a taper angle of a nozzle.

Further, in the simulation, in a nozzle 11 having one-stage structure in the taper shape or the cylindrical shape with no distinction of the small bore section 15 and the large bore section 16, the FIG. 9 shows a change of the intensity of the electric field at the meniscus front end section when the angle of the taper of the nozzle 11 is varied. According to the result, it was found that the intensity of electric field at the meniscus front end section depends on the taper angle of the nozzle 11. The taper angle of the nozzle is preferred to be not more than 30°. Meanwhile, the taper angle means an angle formed between inner surface of the nozzle 11 and the ejecting surface 13 of the nozzle plate 12, thus if the taper angle is zero, the nozzle 11 is in cylindrical shape.

Figure 10:
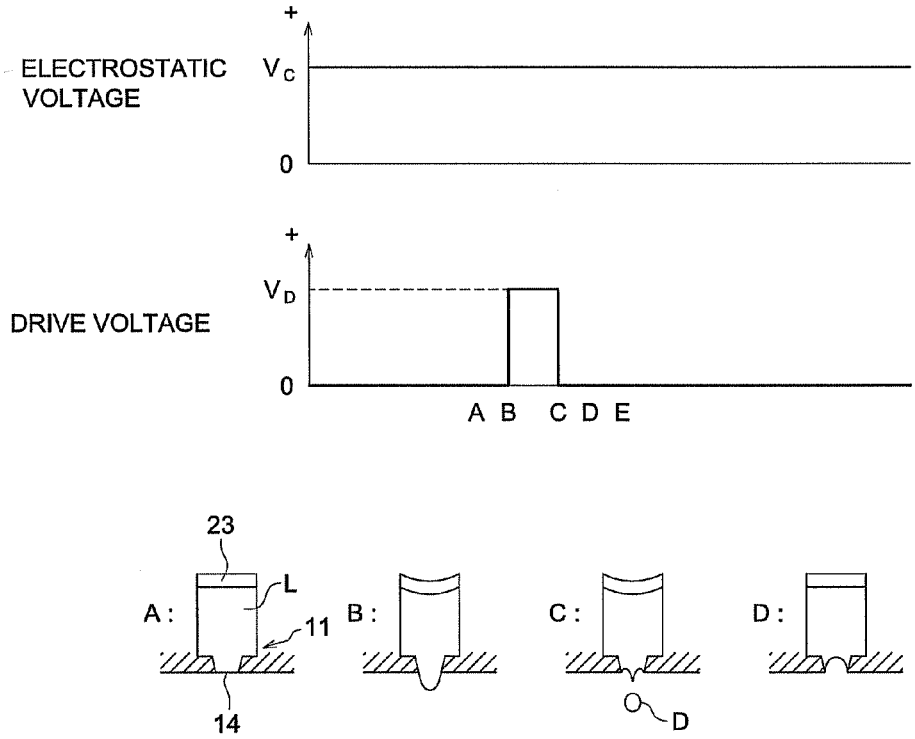
FIG. 10 is a diagram describing drive control of a liquid ejecting head in a liquid ejecting apparatus of a first embodiment.

As FIG. 10 shows, the control device 25 applies a drive voltage in the shape of plus having a voltage value of $V_D$ to the piezoelectric element 23 from the drive voltage power source 24 corresponding to the nozzle 11 respectively to the nozzle to eject the liquid L.

When such drive voltage is applied, the piezoelectric element 23 distorts and increases a pressure of the liquid L inside the nozzle. Thus, at the ejecting port 14 of the nozzle 11, the meniscus of the liquid L starts to rise from a state A in FIG. 10 to a state B where the meniscus has risen.

Then, as described above, high concentration of the electric field occurs at the meniscus front end section and the intensity of the electric field becomes very high, then a strong electro static force is imposed from a steady electric field formed by the electrostatic voltage $V_C$ to the meniscus. By an attraction of this strong electrostatic force, by the pressure of the piezoelectric element 23 and by a surface tension of the liquid L, the meniscus is torn off as C in FIG. 10 to form the droplet D, the droplet D is accelerated by the steady electric field and attracted in a direction of the counter electrode then lands on the substrate K supported by the counter electrode 3.

A this stage, a resistance force of air is applied, however as described above, by the effect of the electro static force, since the droplet D tends to land the nearer place, the droplet lands, the droplet D land on the substrate stably without a landing direction in respect to the substrate being varied.

In the present embodiment, a prescribed electro static voltage $V_C$ applied from the electrostatic power source 19 to the charging electrode 17 is set at 1.5 kV and the voltage value $V_D$ of the voltage in the plus shape applied to the piezoelectric element 23 from the dive voltage power source 24 is set at 20V.

Meanwhile, the drive voltage $V_D$ applied to the piezoelectric element 23, can be the plus shape voltage such as in the present embodiment. In addition it can be configured with, for example, so-called triangular voltage which exhibits a gradual increase followed by gradual decrease, a trapezoidal voltage where the voltage increases gradually, maintain a constant level for some time, and decreases gradually, or a sine wave voltage. It is also possible to make such arrangements as shown in FIG. 11 (A) that voltage $V_D$ is applied to the piezoelectric element 23 at all times, then it is turned off once. Then the voltage $V_D$ is again applied, and liquid droplet D is ejected at the time of startup. It is also possible to apply various forms of drive voltage $V_D$ as shown in FIGS. 11 (B) and (C).

Also, in the present embodiment, the meniscus risen by distortion of the piezoelectric element 23, is separated by the electrostatic attraction force to be formed into the droplet and accelerated by the steady electric field by electro static voltage $V_C$ to land on the substrate. Other than this, for example, a strong drive voltage where the liquid L becomes a droplet only by distortion of the piezoelectric element 23 can be applied.

As described above, when the liquid L is ejected from the nozzle 11, the inner periphery section of the nozzle 11, the liquid L in the nozzle 11, the meniscus, the ejecting surface 13 of the nozzle plate 12 and the counter electrode 3 are charged as FIG. 13 shows. At maintenance, the charging has to be discharged appropriately, other wise, for example, as FIG. 14 shows, there is occurred a problem that the meniscus cannot be formed at the ejecting port section of the nozzle 11 and the liquid L cannot be ejected.

In the present embodiment, at maintenance, first, printing is performed on the substrate K by actually ejecting the liquid and an operator visually inspects defective nozzles. Then if the operator judges that maintenance such as cleaning is necessary, by an instruction from the operator, a drive control signal is transmitted from the control device 25 to a motor to move the carriage 5 in the main scanning direction along the guide rail 4, then the carriage 5 is conveyed to a maintenance position and then the liquid head 6 mounted on the carriage 5 is placed above the discharging device 7.

In this state, the control device 25 drives the discharging drive power source 71 of the discharging device 7 so that the discharging member 70 comes in contact with the ejecting surface 13 of the nozzle plate 12 of the liquid ejecting head 6. Since the discharging member 70 is formed in a shape of a flat plate, it comes in contact with the whole area of the ejecting surface 13 of the nozzle plate 12.

At this stage, if the discharging member 70 is formed with the porous material having spongelike interconnected bubbles impregnating conductive water, formed with the porous material having conductivity or formed with the conductive plate-shaped member such as metal plate, electric charge on the nozzle plate shown in FIG. 13 and FIG. 14, electric charge on liquid L or dirt adhering on the ejecting surface 13 of the nozzle plate 12 can be discharged via the discharging member or water impregnated in the discharging member 70 thus the nozzle plate 12 is discharged.

Meanwhile, as the present embodiment if the discharging member 70 is formed with the porous material having spongelike interconnected bubbles, the water impregnated discharges the nozzle plate 12, at the same time the liquid L or the dirt adhering on the ejecting surface 13 are dissolved and dispersed, thus it is possible to removed them from the ejecting surface 13. Also, it is possible to prevent that the liquid L adhering on the ejecting surface 13 interferers charging at charging to be described.

Also, if charging is carried out while the water impregnated in the discharging member 70 in a shape of dew is being adhering on the ejecting surface 13 of the nozzle plate 12, uneven charging occurs readily. Thus it is preferred that cleaning such as wiping by a blade is carried out for the ejecting surface 13 so as to enable even charging after discharging the nozzle plate 12.

After maintenance of the liquid ejecting head is completed, the control device 25 carries out charging of the liquid in the nozzle by moving the carriage, on which the liquid ejecting head 6 is mounted, from the maintenance position to an upper side of the counter electrode 3 along the guide rail 4.

Charging of the liquid in the nozzle is carried out by applying the electrostatic voltage representing an operation voltage to the charging electrode 17 of the liquid ejecting head 6 from the electrostatic voltage power source 19. Usually, a distance between nozzle plate 12 and the substrate K is about 1 mm at liquid ejecting, and a subscribed electrostatic voltage is applied form the electrostatic voltage power source 19 to the charging electrode 17 to charge the liquid in the nozzle for liquid ejecting.

As above, according to the liquid ejecting apparatus 1 related to the present invention, different form conventional discharging member in the shape of a brush or a blade, the discharging member 70 of the discharging device 7 is a discharging member in the shape of flat plate having conductivity which comes in contact with whole area of the ejecting surface 13 of the nozzle plate 12. Therefore, in case of the discharging member in the shape of brush, there were portions in contact with the discharging member and not in contact with the discharging member on the ejecting surface 13. In case of the discharging member in the shape of the plate, such trouble does not occur and all of charging on the nozzle plate 12 is discharged by contacting whole area of the ejecting surface 13.

Also, in case of the discharging members in the shape of the blade or the brush, if a particular portion of the nozzle plate 12 is focused, the discharging member passes in a very short time, thus discharging was not always sufficient. To perform sufficient discharging, the blade had to be slid on the nozzle surface a plurality of times thus discharging required a long time. Further as FIG. 14 (B) shows, with the discharging member in the shape of the blade, the dirt was difficult to be removed from the ejecting surface 13 and the dirt charged positively was spread to a large area.

However, the discharging member 70 of the present embodiment can discharge sufficiently by contacting it with the ejecting surface 13 of the nozzle 12 for a prescribed time of period, thus sufficient and steady discharging can be carried out in a short time.

Further, in the present embodiment, since the discharging member 70 does not slide on the ejecting surface 13 of the nozzle plate 12, it can prevent that the liquid or dirt adhering on the ejecting surface is spread to the large area on the ejecting surface as shown in FIG. 14 and the meniscus of the liquid L is not formed as shown in FIG. 13.

Also, in the present embodiment after the discharging member 70 erases an affect of a record of charging of the nozzle plate in previous liquid ejecting by discharging, a subsequent ejecting cycle in which next charging is carried out is carried out. Therefore, in the next charging, since an appropriate even charging can be carried out, the electrostatic force applied to the liquid in the nozzle becomes an appropriate value and a stable ejecting can be carried out.

As above, according to the liquid ejecting apparatus 1 related to the present invention, the entire ejecting surface of the nozzle plate 12 can be discharged steady and sufficiently in short time by the conductive discharging member 70 in the shape of the flat plate, thus when ejecting the liquid, the meniscus of the liquid L can be formed correctly at the ejecting port section 14 of the nozzle 11 by creating concentration of the electric field and correct ejecting of the liquid can be realized.

Meanwhile, in the present invention, while the shape of the discharging member 70 is not restricted as far as it can be in contact with the entire ejecting surface of the nozzle plate 12, it is preferred to be in the shape of the flat plate.

Second Embodiment

Figure 12:
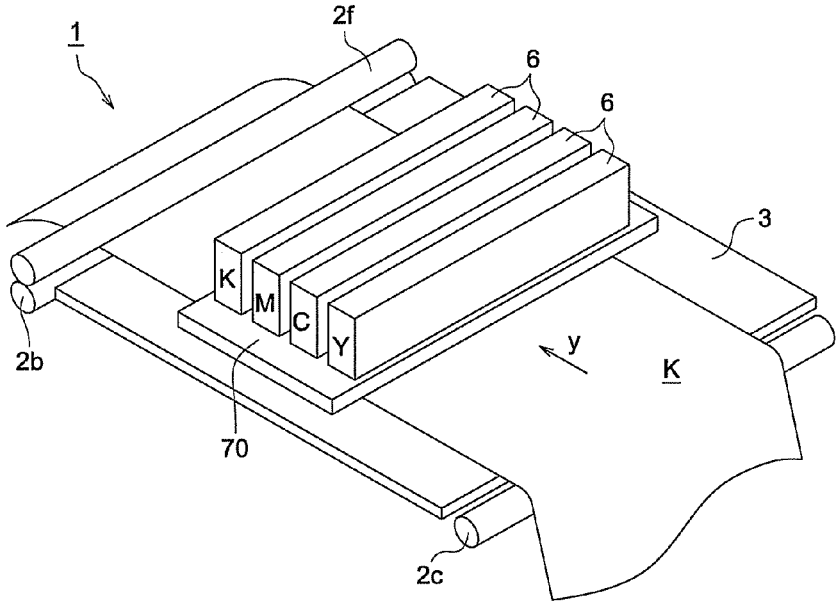
FIG. 12 is a perspective view showing a relevant structure of a liquid ejecting apparatus related to a second embodiment.

In a second embodiment, so-called line method liquid ejecting apparatus will be described. FIG. 12 is a perspective view showing configuration of related part of the liquid ejecting apparatus related to the embodiment. Meanwhile, members having the same function are denoted by the same symbols as that in the first embodiment.

FIG. 12 is a perspective view showing a configuration of related part of the liquid ejecting apparatus related to the embodiment. In the liquid ejecting apparatus 2, a counter electrode 3 supporting the substrate K from the reverse side is disposed substantially horizontal. The substrate K is conveyed in a conveyance direction shown by an arrow y in the figure along a surface of the counter electrode 3.

On a downstream side of the counter electrode 3 in the conveyance direction, a drive roller 2*b* to move the substrate K in the conveyance direction is provided. Above the drive roller 2*b*, pinch roller 2*f* is provided to grasp the substrate K between the drive roller 2*b* so that a conveyance force of the drive roller 2*b* is transferred to the substrate K. Also, on an upstream side of the counter electrode 3 in the conveyance direction, a guide roller 2*c* to guide the substrate K onto the counter electrode is provided.

Above the counter electrode 3, a liquid ejecting heads 6 are allocated in a width direction in an extending manner. Meanwhile, FIG. 12 schematically shows the liquid ejecting head 6 and in practice, number, length and layout of liquid ejecting ports 6 are determined arbitrarily. Also, to the liquid ejecting head 6, an unillustrated ink tank to reserve and supply each color of ink to the liquid ejecting head 6 is connected via unillustrated supply tube.

The structure of the liquid ejecting head 6, discharging apparatus 7 and detaching device 27 and the principle of liquid ejecting is as described in the first embodiment with reference to the FIG. 2, thus the description is omitted. Meanwhile, in the present embodiment also, a head main body section 10 of the liquid ejecting head 6 is configured as a head having so-called a flat ejecting surface where a nozzle 11 is not protruding form the ejecting surface 13 opposed to the counter electrode 3 of a nozzle plate 12.

In the present embodiment, the liquid ejecting head 6 does not reciprocate above the counter electrode 3 thus a maintenance position cannot be set as in the first embodiment. Thus at discharging, the liquid ejecting head 6 and the counter electrode 3 are divorced in a Z direction shown in FIG. 2 so as to insert a discharging member 70 of a discharging device 7 between the liquid ejecting head 6 and the counter electrode 3 in a way that the discharging member 70 comes in contact with the ejecting surface 13 of the nozzle plate 12.

Thus, at discharging, the control device 25 drives the detaching device drive power source 28 of the detaching device 27 so as to divorce the liquid ejecting head 6 and the counter electrode 3 in a prescribed distance and drives the discharging drive power source 71 of the discharging device 7 so as to insert the discharging member 70 in a way that the discharging member 70 comes in contact with the ejecting surface 13 of the nozzle plate 12.

In this configuration, at maintenance, the control device transmits a drive control signal to the detaching drive power source 28 and the detaching drive power source 28 divorces the liquid ejecting head 6 and the counter electrode 3 in a prescribed distance. Then when the drive control signal is transmitted from the control device 25 to the discharging drive power source 71, the discharging drive power source 71 inserts the discharging member 70 between the liquid ejecting head 6 and the counter electrode 3 so that the discharging member 70 comes in contact with the ejecting surface 13 of the nozzle plate 12. Since the discharging member 70 is formed in a shape of a flat plate, it can be in contact with the entire ejecting surface 13 of the nozzle plate 12.

At this stage, if the discharging member 70 is formed with the porous material having spongelike interconnected bubbles impregnating conductive water, formed with the porous material having conductivity or formed with the conductive plate-shaped member such as metal plate, electric charge on the nozzle plate shown in FIG. 13 and FIG. 14 and electric charge of liquid L or dirt adhering on the ejecting surface 13 of the nozzle plate 12 can be discharged via the discharging member or water impregnated in the discharging member 70 and the nozzle plate 12 is discharged.

Meanwhile, as the present embodiment, if the discharging member 70 is formed with the porous material having spongelike interconnected bubbles, the water impregnated discharges the nozzle plate 12, at the same time the liquid L or the dirt adhering on the ejecting surface 13 are dissolved and dispersed, thus it is possible to remove them from the ejecting surface 13. Also, it is possible to prevent that the liquid L adhering on the ejecting surface 13 interferers charging at charging to be described later.

As above, in the liquid ejecting apparatus 2 related to the present embodiment, the effect of the first embodiment can be realized in the same manner.

Meanwhile, in the first and second embodiments, the liquid ejecting head 6 having the flat ejecting surface 13 where the nozzle 11 is not protruding from the ejecting surface 13 of the nozzle plate 12 have been described. A liquid ejecting head 6 having an ejecting surface where the nozzle 11 is protruding from the ejecting surface 13 of the nozzle plate 12 can be discharged by the same discharging device 7.

At this stage it is possible to carry out discharging by the discharging member in contact with the ejecting surface 13 using a discharging member 70 of the discharging device 7 having a flat plate with the same flexibility as aforesaid one, however since there is a possibility to damage a projection section of the nozzle 11 it is preferred to use a substantially flat plate where a concave section corresponding the projection section of the nozzle 11 is formed.

Also, in the present embodiment, the case where the distortion of the piezoelectric element 23 is used as the pressure generating device to rise the meniscus of the liquid L at the ejecting port 14 of the nozzle have been described. As the pressure generating device, as far as it has the function of the pressure generating, for example, a configuration where the liquid L in the nozzle 11 or cavity 21 is heated, to create bubbles, and the pressure of the bubbles is used. Also, The present invention can be applied for a type of a liquid ejecting apparatus where the liquid is ejected only by the electrostatic force between the liquid ejecting head 6 and the counter electrode 3 without using the pressure generating device.

Further, in the present invention, while the case where the counter electrode is grounded, for example, a configuration where a voltage is applied to the counter electrode 3 from a power source and the control device 25 controls the power source so that a difference of the voltages between the liquid ejecting head 6 and the counter electrode 17 becomes a prescribed voltage such as 1.5 kV.

What is claimed is:

1. A liquid ejecting apparatus, comprising:
a counter electrode;
a liquid ejecting head, comprising:
a nozzle plate including a nozzle to eject liquid opposed to the counter electrode,
a charging electrode opposed to the counter electrode via the nozzle plate, and
an electrostatic voltage applying device to apply an electrostatic voltage onto the liquid in the nozzle,
a discharging device provided with a conductive discharging member having a flat contact surface to discharge the charge from the charged nozzle plate, wherein the discharging member is formed with a porous material having interconnected cells; and
a control device to control the electrostatic voltage applying device and the discharging device;
wherein the flat contact surface of the discharging member simultaneously contacts with a whole area of the nozzle plate opposite to the counter electrode.

2. The liquid ejecting apparatus of claim 1, wherein the discharging member is impregnated with liquid having a conductive characteristic.

3. The liquid ejecting apparatus of claim 1, wherein a volume resistivity of the nozzle plate is not less than $10^{15}$ Ωm.

4. The liquid ejecting apparatus of claim 2, wherein a volume resistivity of the nozzle plate is not less than $10^{15}$ Ωm.

5. The liquid ejecting apparatus of claim 1, wherein an inner diameter of an ejecting port of the nozzle is not more than 15 μm.

6. The liquid ejecting apparatus of claim 2, wherein an inner diameter of an ejecting port of the nozzle is not more than 15 μm.

7. The liquid ejecting apparatus of claim 1, wherein the surface of the nozzle plate opposed to the counter electrode is flat.

8. The liquid ejecting apparatus of claim 2, wherein the surface of the nozzle plate opposite to the counter electrode is flat.

9. The liquid ejecting apparatus of claim 1, wherein the control device controls the electrostatic voltage applying device so that the electrostatic voltage is applied onto the liquid in the nozzle after the nozzle plate is discharged by the discharging device.

10. The liquid ejecting apparatus of claim 2, wherein the control device controls the electrostatic voltage applying device so that the electrostatic voltage is applied onto the liquid in the nozzle after the nozzle plate is discharged by the discharging device.

11. A liquid ejecting apparatus, comprising:
a counter electrode;
a liquid ejecting head comprising:

a nozzle plate including a nozzle to eject liquid opposed to the counter electrode, a pressure generating device to protrude a meniscus of the liquid at an ejecting port of the nozzle, a charging electrode opposed to the counter electrode via the nozzle plate, and an electrostatic voltage applying device to apply an electrostatic voltage onto the liquid in the nozzle, a discharging device formed with a porous material having interconnected cells to discharge the charge from the charged nozzle plate; and a control device to control the pressure generating device, the electrostatic voltage applying device and the discharging device;

wherein the discharging device provides a conductive discharging member contactable with a whole area of the nozzle plate opposite to the counter electrode.

12. The liquid ejecting apparatus of claim 11, wherein the discharging member is impregnated with liquid having a conductive characteristic.

13. The liquid ejecting apparatus of claim 11, wherein a volume resistivity of the nozzle plate is not less than $10^{15}$ Ωm.

14. The liquid ejecting apparatus of claim 12, wherein a volume resistivity of the nozzle plate is not less than $10^{15}$ Ωm.

15. The liquid ejecting apparatus of claim 11, wherein a thickness of the nozzle plate is not less than 75 μm.

16. The liquid ejecting apparatus of claim 12, wherein a thickness of the nozzle plate is not less than 75 μm.

17. The liquid ejecting apparatus of claim 11, wherein an inner diameter of an ejecting port of the nozzle is not more than 15 μm.

18. The liquid ejecting apparatus of claim 12, wherein an inner diameter of an ejecting port of the nozzle is not more than 15 μm.

19. The liquid ejecting apparatus of claim 11, wherein the surface of the nozzle plate opposite to the counter electrode is flat.

20. The liquid ejecting apparatus of claim 12, wherein the surface of the nozzle plate opposite to the counter electrode is flat.

21. The liquid ejecting apparatus of claim 11, wherein the control device controls the electrostatic voltage applying device so that the electrostatic voltage is applied onto the liquid in the nozzle after the nozzle plate is discharged by the discharging, device.

22. The liquid ejecting apparatus of claim 12, wherein the control device controls the electrostatic voltage applying device so that the electrostatic voltage is applied onto the liquid in the nozzle after the nozzle plate is discharged by the discharging device.

* * * * *